United States Patent [19]

Newell

[11] 4,322,123

[45] Mar. 30, 1982

[54] CRIMPING TOOL AND ELECTRICAL CONNECTOR ASSEMBLY

[76] Inventor: Carl W. Newell, 6735 San Fernando, Glendale, Calif. 91201

[21] Appl. No.: 82,952

[22] Filed: Oct. 9, 1979

[51] Int. Cl.[3] ..... H01R 4/10

[52] U.S. Cl. ..... 339/276 R; 29/751; 72/410; 339/228

[58] Field of Search ..... 339/276, 228; 174/84 C; 29/751, 753; 72/410

[56] References Cited

U.S. PATENT DOCUMENTS

| | | | |
|---|---|---|---|
| 2,314,884 | 3/1943 | Klein | 174/84 C |
| 3,377,609 | 4/1968 | Shannon et al. | 339/224 X |
| 4,048,877 | 9/1977 | Undin | 29/751 X |
| 4,049,335 | 9/1977 | Julian et al. | 339/276 T X |

FOREIGN PATENT DOCUMENTS

| | | | |
|---|---|---|---|
| 133733 | 1/1979 | German Democratic Rep. | 339/276 R |

*Primary Examiner*—Eugene F. Desmond
*Attorney, Agent, or Firm*—Lyon & Lyon

[57] ABSTRACT

Disclosed herein is a crimping tool and an electrical crimping assembly particularly adapted for use in replacing automotive battery terminal connectors. The assembly includes a non-corrosive coupling adapted to be secured to a battery terminal, an electrical cable extending therefrom and a tubular connector, one end thereof being in crimped electrical contact with the cable and the open other end being adapted to receive the stripped end of an existing automotive ground or hot lead. The tool which is particularly adapted for crimping the open end of the tubular connector about the stripped end of the lead and thereby forming an electrical and structural connection between the tubular connector and lead is comprised of an integrally formed V-shaped member defining a pair of crimping arms, one of said arms defining a crimping tooth at the end thereof and the other of said arms having an arcuate recessed area therein adapted to receive a portion of the tubular connector such that upon forcing the two arms of the tool together with any suitable means, the tubular coupling is crimped onto said lead.

6 Claims, 6 Drawing Figures

CRIMPING TOOL AND ELECTRICAL CONNECTOR ASSEMBLY

BACKGROUND OF THE INVENTION

The connecting mechanisms which are used to connect the ground and hot leads to the battery in an automobile have been generally standardized for years and the problem which consistently plagues such connections is one of corrosion. Corrosion results from the acid used in such batteries acting on the metal of which these standard connectors are constructed. An inert metal such as lead which would eliminate this problem has not been widely employed in connecting mechanisms due to its lack of memory, i.e., once deformed it will retain its deformed state after the pressure causing such deformation has been relieved. When lead is used in the standard threaded connecting mechanism, once the pressure exerted by the tightening screw is relieved, the connector still has to be forcibly removed from the battery terminal. Accordingly, inert metals such as lead have often been avoided in the past. Nevertheless, given the proper construction of a lead coupling, such a device would certainly be preferable over the standard metal connecting mechanisms as the corrosion on the terminals with its obvious deleterious effects would be eliminated.

Despite the development of an improved lead coupling, a problem remains of how to economically equip the existing automobiles' hot and ground leads with such a new coupling in place of corrosion susceptible couplings. Simply to remove the existing connecting mechanisms and replace them with a lead coupling would require special equipment and know-how not generally possessed by most automobile owners and the inconvenience and expense of having such a conversion made in an automobile garage would most likely outweigh the benefits to be obtained by the new coupling in the eyes of most automobile owners. It would be highly desirable to provide an assembly by which old battery coupling could be easily replaced with an improved lead coupling by a person of average mechanical ability without the need for specialized equipment. Such an assembly has been developed and is described below.

While it should be readily apparent from the description of the assembly disclosed herein, it should be noted that the assembly can also be used in making and securing a wide variety of electrical couplings in addition to the preferred use in securing improved automotive battery couplings to existing automotive ground and hot leads.

SUMMARY OF THE INVENTION

Briefly, the invention comprises an electrical connecting assembly including an electrical cable in crimped electrical and structural communication with one end of an electrically conductive tubular connector, the other end of the connector being adapted to receive the stripped end of a second electrical cable and to be secured thereto by a V-shaped crimping tool which cradles the connector and when pressed together crimps a portion thereof into the second cable forming a structural and electrical connection therewith. An insulating sleeve is slidably disposed about the first cable such that upon crimping the tubular connector into the second cable, the sleeve can be slid over the connector thereby insulating the connection.

It is the principal object of the present invention to provide an assembly for economically and simplistically replacing the standard connecting mechanisms for securing the ground and hot leads of an automobile with non-corrosive lead couplings.

It is another object of the present invention to provide a connecting mechanism for splicing together lengths of electric cable.

It is a still further object of the present invention to provide a connecting mechanism for splicing together lengths of electrical cable which is of simple construction and economical to manufacture.

It is yet another object of the present invention to provide a connecting mechanism for splicing together lengths of electric cable which can be easily operated without the need of specialized tooling.

It is still a further object of the present invention to provide an assembly for replacing the standard connecting mechanisms for securing the ground and hot leads of an automobile to its battery with a non-corrosive lead coupling which can be easily installed without the need for specialized equipment.

It is yet another object of the present invention to provide a tool for splicing together lengths of electrical cable which is easily used, of simple construction and economical to manufacture.

These and other objects and advantages of the present invention will become apparent from the following description taken in conjunction with the accompanying drawings.

DESCRIPTION OF THE PREFERRED EMBODIMENT

Figure 1:
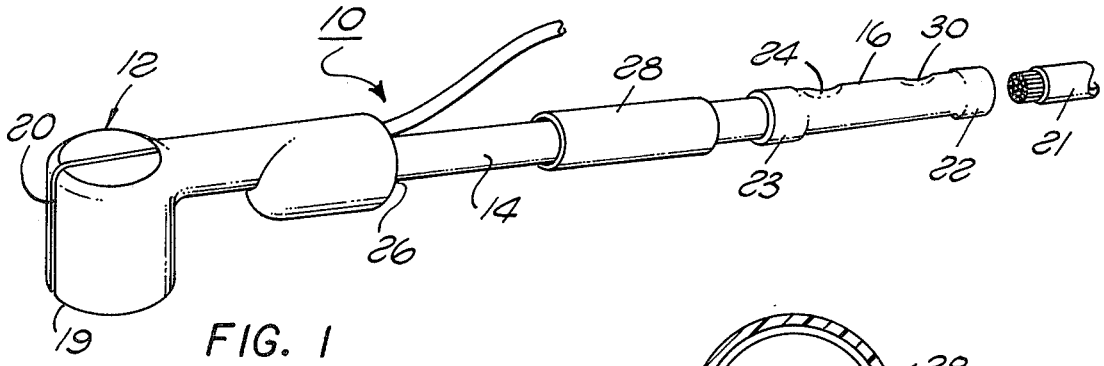
FIG. 1 is a perspective view of the electrical connector assembly and an electrical cable to which the assembly is to be secured.
Figure 6:
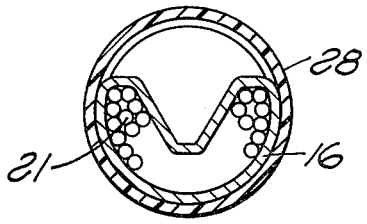
FIG. 6 is a sectional view illustrating the tubular connector in crimped connection with an electrical cable.

Referring now in detail to the drawings, the electrical connector assembly is comprised of a non-corrosive automotive battery coupling 12, an electrical cable 14, a tubular connector 16 and a crimping tool 18. The coupling 12 is preferably constructed of lead; is secured to the electrical cable 14 by a standard pressed fit; is provided with a recessed are 19 adapted to receive a terminal of the automobile battery (not shown); and is provided with a transverse slot 20 allowing the coupling to be deformed about the terminal by any conventional tightening mechanism. In addition to a simple press fit, a battery cable connector such as those described in U.S. Pat. Nos. 3,529,281 and 3,838,386 can be employed to secure the coupling about the terminal.

Prior to securing the assembly 10 to a second electrical cable or automotive lead 21, the tubular connector which is constructed of an electrically conductive material such as copper and is provided with enlarged ends 22 and 23 to facilitate the insertion of a cable end therein, is crimped at 24 thereby securing the tubular connector electrically and structurally with cable 14. The coupling 12 secured to the other end 26 of cable 14 and an insulating sleeve 28 is slidably disposed over cable 14 adjacent the tubular connector 16. The tubular connector is also provided with an indent 30 in the wall thereof between the open end 22 and crimp 24. To secure the assembly 10 to cable 21 it is only necessary to strip the insulation from the end of cable 21, insert the stripped end within the tubular connector and with the use of tool 18, crimp the tubular connector at indent 30 thereby electrically and structurally securing the tubular connector and assembly 10 to cable 14.

Figure 2:
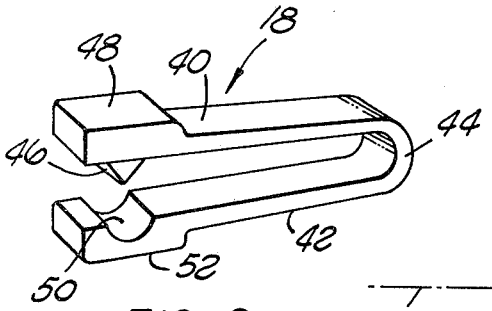
FIG. 2 is a perspective view of the crimping tool.
Figure 3:
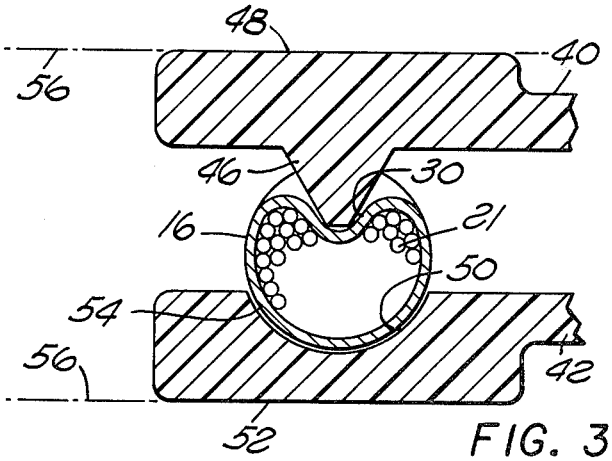
FIG. 3 is a sectional view of the electrical connector assembly and tool prior to crimping the assembly to an electrical cable.
Figure 5:
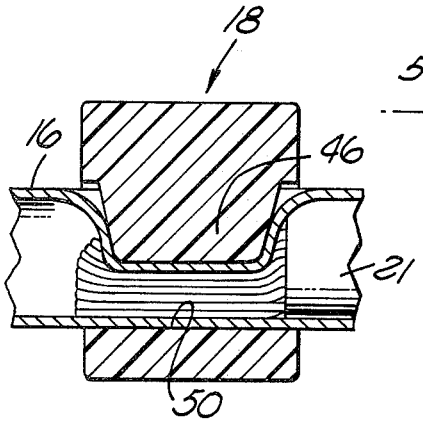
FIG. 5 is a sectional view taken along FIG. 5—5 in FIG. 4.
Figure 4:
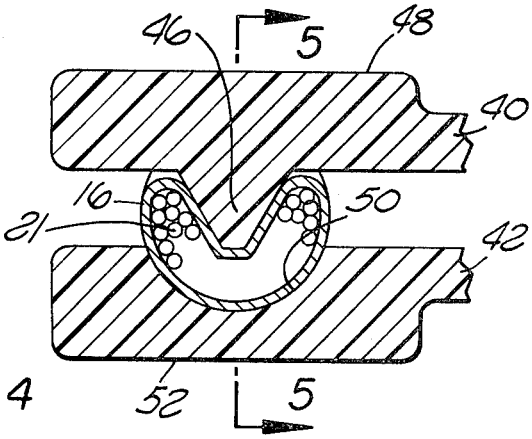
FIG. 4 is a sectional view of the electrical crimping assembly and tool after crimping the assembly to an electrical cable.

The crimping tool 18 illustrated in FIG. 2 is preferably constructed of a hard flexible material such as nylon and is of a V-shaped configuration defining arm portions 40 and 42 which are integrally joined at 44. Arm portion 40 has integrally formed therewith an inwardly directed crimping tooth 46 and an outwardly directed gripping surface 48. Arm portion 42 has integrally formed therewith an arcuate recessed area 50 adapted to receive a portion of the tubular connector as shown in FIG. 5 and an outwardly directed gripping surface 52.

In use, after placing the stripped end of the cable 21 within the open end 22 of the tubular connector 16, the tubular connector is placed between the arm portions 40 and 42 of the crimping tool such that the preformed indent 30 in the connector is below the crimping tooth 46 of tool 18 and the rounded surface 54 of the tubular connector opposite indent 30 is disposed within the recessed area 50 of tool 18. The arm portions of the tool are then pressed toward each other by vise grips 56 or any other suitable gripping tool. The force generated by the vise grips on the gripping surfaces of the tool 18 cause the tooth 46 defined by the tool 18 to press the indent into the cable 21, causing the cable to be securely fastened to the tubular connector in electrical contact therewith. The recessed area 50 in arm portion 44 prevents any additional undesirable deformation of the tubular connector during the crimping procedure. After the tubular connector is secured to cable 21, the insulating sleeve 28 is slid over the tubular connector providing insulation for the electrical connection between cables 14 and 21.

While the electrical connecting assembly 10 is described above as an assembly for replacing automotive battery terminal connectors, it is to be understood that the combination of the tubular connector 16 and tool 18 is adapted for use in securing together any two electrical cables. For such use, the assembly need only comprise the tubular connector 16, tool 18 and, of course, an insulating sleeve should also be provided. Various other changes and modifications may be made in carrying out the present invention without departing from the spirit and scope thereof. Insofar as these changes and modifications are within the purview of the appended claims they are to be considered as part of the present invention.

I claim:

1. A connector assembly for providing a non-corrosive coupler for a battery cable, said assembly comprising a coupling member adapted to be secured to a battery terminal, an electrical cable, one end of said cable being secured to said coupling member, a tubular member constructed of an electrically conductive material, one end of said member being secured to said cable in electrical contact therewith and the other end of said member being adapted to receive said battery cable and a substantially V-shaped crimping member adapted to be disposed about a portion of said tubular member, said crimping member being of single piece construction and defining a pair of arm portions integrally joined at one end thereof, one side of one said arm portions defining a recessed area therein adapted to receive a portion of said tubular member, one side of the other of said arm portions defining a tooth member projecting toward said recessed area and the other side of both of said arm portions defining substantially flat outwardly disposed engagement surfaces, said surfaces being adapted for gripping contact with a conventional squeezing tool for forcing said tooth member toward said recessed area such that upon disposing said battery cable within said other end of said tubular member and said crimping member about said portion of said tubular member and urging said engagement surfaces defined by said crimping member together, said tubular member is crimped into said battery cable thereby structurally and electrically securing said connector assembly to said battery cable.

2. The combination of claim 1 including a detent in said tubular member, said detent being adapted to receive said tooth member upon said crimping member being disposed about said portion of said tubular member.

3. The combination of claim 1 including a sleeve of insulating material slidably disposed about said electrical cable and being adapted to be disposed about said tubular member upon said connector assembly being secured to said battery cable.

4. A connector assembly for joining together lengths of cable in electrical communication, said assembly comprising a tubular member constructed of an electrically conductive material, one end of said material being adapted to receive one of said cables and the other end of said member being adapted to receive the other of said cables and a substantially V-shaped crimping member adapted to be disposed about said tubular member for crimping said tubular member into said cables thereby structurally and electrically communicatinng said cables, said crimping member being of single piece construction and defining a pair of arm portions integrally joined at one end thereof, one side of one of said arm portions defining a recessed area therein adapted to receive a portion of said tubular member, one side of the other of said arm portions defining a tooth member projecting toward said recessed area and the other side of both of said arm portions defining substantially flat outwardly disposed engagement surfaces, said surfaces being adapted for gripping contact with a conventional squeezing tool for forcing said tooth member toward said recessed area such that upon disposing one of said cables within one of said ends of said tubular connector and said crimping member about the portion of said tubular connector disposed about said cable and urging said engagement surfaces defined by said crimping member together, said tubular member is crimped into said cable and upon disposing the other of said cables within said other end of said tubular connector and said crimping member about the portion of said tubular connector disposed about the other end of said cable and forcing said engagement surfaces together, said tubular member is crimped into said other cable thereby structurally and electrically securing together said cables.

5. The combination of claim 4 including a detent in said tubular member, said detent being adapted to receive said tooth member upon said crimping member being disposed about said portion of said tubular member.

6. The combination of claim 4 including a sleeve of insulating material adapted to be disposed about said tubular member.

* * * * *